US007720412B2

(12) United States Patent
Anan et al.

(10) Patent No.: US 7,720,412 B2
(45) Date of Patent: May 18, 2010

(54) PROCESS CARTRIDGE

(75) Inventors: Osamu Anan, Susono (JP); Akinobu Hirayama, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 105 days.

(21) Appl. No.: 11/951,669

(22) Filed: Dec. 6, 2007

(65) Prior Publication Data

US 2008/0138109 A1 Jun. 12, 2008

(30) Foreign Application Priority Data

Dec. 11, 2006 (JP) ..... 2006-332739

(51) Int. Cl.
*G03G 21/18* (2006.01)

(52) U.S. Cl. ..... 399/115; 399/111; 399/176

(58) Field of Classification Search ..... 399/110, 399/111, 113, 115, 119, 168, 174, 176
See application file for complete search history.

(56) References Cited

U.S. PATENT DOCUMENTS

| | | | | |
|---|---|---|---|---|
| 5,465,136 | A | 11/1995 | Watanabe | |
| 6,980,759 | B2 * | 12/2005 | Kanno et al. | 399/111 |
| 7,099,607 | B2 | 8/2006 | Suzuki et al. | 399/111 |
| 2005/0276628 | A1 | 12/2005 | Anan et al. | 399/109 |
| 2007/0092291 | A1 | 4/2007 | Suzuki et al. | 399/111 |

FOREIGN PATENT DOCUMENTS

| | | |
|---|---|---|
| JP | 4-043378 | 2/1992 |
| JP | 5-188667 | 7/1993 |
| JP | 6-273987 | 9/1994 |
| JP | 2900530 | 7/1999 |
| JP | 2000-181328 | 6/2000 |
| JP | 2001-337511 | 12/2001 |

* cited by examiner

*Primary Examiner*—David P Porta
*Assistant Examiner*—Benjamin Schmitt
(74) *Attorney, Agent, or Firm*—Fitzpatrick, Cella, Harper & Scinto

(57) ABSTRACT

A process cartridge in which before use, the separation of a predetermined distance between a charging roller and a photosensitive drum can be maintained, and in use, the separation state of the charging roller can be released without increasing the burden on a user. The process cartridge includes a charging roller separation member moveable between the first position to hold the separation of the charging roller from the photosensitive drum and the second position to abut the charging roller on the photosensitive drum. One of a photosensitive member unit and a developing unit includes a hook portion holding the separation member in the first position, and the other includes a hook portion that releases the separation member from the hook portion to move the separation member to the second position when the developing unit is pivoted.

8 Claims, 14 Drawing Sheets

PROCESS CARTRIDGE

BACKGROUND OF THE INVENTION

1. Field of the Invention

The present invention relates to a process cartridge detachably mountable to an electrophotographic image forming apparatus such as an electrophotographic copying machine and an electrophotographic printer.

Here, the electrophotographic image forming apparatus forms an image on a recording sheet using an electrophotographic image forming method, and examples of the electrophotographic image forming apparatus include an electrophotographic copying machine, an electrophotographic printer (for example, a laser beam printer and an LED printer), a facsimile machine and a word processor.

Furthermore, a process cartridge is a cartridge into which at least one of a charging member, a developing unit and a cleaning unit, and an electrophotographic photosensitive member are integrally incorporated, the cartridge being detachably mountable to a main body of an image forming apparatus.

2. Description of the Related Art

Conventionally, as an electrophotographic image forming apparatus, there is a color electrophotograpic image forming apparatus of an in-line type in which a plurality of process cartridges are aligned. There is a contact development method of performing a development in the state in which a developing roller forming a process cartridge is in contact with a photosensitive drum. In this method, in order to keep a predetermined contact pressure between the developing roller and the photosensitive drum during image formation, the developing roller is urged against the photosensitive drum.

In the case of this method, when the process cartridge is not used for a long time period in the state of being mounted on the image forming apparatus main body, there is a possibility that an elastic layer of the developing roller is permanently deformed. Therefore, an uneven image may be formed at the time of development.

As a result, there was proposed a process cartridge and an image forming apparatus in which there is provided a mechanism for separating the developing roller from a photosensitive drum in the case of performing no image forming operation (Japanese Patent No. 2900530 (which is matured from Japanese Patent Application Laid-Open No. H04-43378) and Japanese Patent Application Laid-open No. 2001-337511).

In addition, the construction in which a charging roller serving as a charging member is abutted on a photosensitive drum for charging the photosensitive drum is widely used. In such a contact charging mechanism, since the charging roller needs to be disposed reliably in contact with the photosensitive drum surface, the charging roller is in pressure contact with the photosensitive drum surface at a predetermined contact pressure. When the state of not being used for a long time period continues, the elastic layer of the charging roller is permanently deformed, and thus, an image of uneven density is formed.

Thus, there has been proposed a method in which an insert member for separating the charging roller from the photosensitive drum is inserted therebetween at the time of shipment of a process cartridge, and a user removes the insert member in use (Japanese Patent Application Laid-Open No. H05-188667).

Alternatively, there has been proposed a process cartridge having a mechanism in which a charging roller, having been separated during shipment is brought into abutment with the photosensitive drum when the process cartridge is mounted on the image forming apparatus main body (Japanese Patent Application Laid-Open No. H06-273987 and Japanese Patent Application Laid-Open No. 2000-181328).

SUMMARY OF THE INVENTION

The present invention provides a process cartridge and an image forming apparatus that are improvements of the above-described inventions. That is, according to the present invention, before use, a charging member can be separated from an electrophotographic photosensitive member, and in use, the separation state of the charging member can be released without an increase in the burden on a user.

In addition, the present invention provides a process cartridge comprising: a photosensitive member unit including an electrophotographic photosensitive member; a developing unit movable relatively with respect to the photosensitive member unit, and including a developing roller developing an electrostatic latent image formed on the electrophotographic photosensitive member; a charging member charging the electrophotographic photosensitive member; and a separation member movable between a first position to separate the charging member from the electrophotographic photosensitive member and a second position to abut the charging member on the electrophotographic photosensitive member. The separation member includes an engaging portion engaging with the photosensitive member unit to position the separation member in the first position and a force receiving portion receiving a force from the developing unit for releasing an engagement between the photosensitive member unit and the engaging portion to move the separation member to the second position when the developing unit is moved relatively with respect to the photosensitive member unit.

Moreover, the present invention provides a process cartridge comprising: a photosensitive member unit including an electrophotographic photosensitive member; a developing unit movable relatively with respect to the photosensitive member unit, and including a developing roller developing an electrostatic latent image formed on the electrophotographic photosensitive member; a charging member charging the electrophotographic photosensitive member; and a separation member movable between a first position to separate the charging member from the electrophotographic photosensitive member and a second position to abut the charging member on the electrophotographic photosensitive member. The separation member includes an engaging portion engaging with the developing unit to position the separation member in the first position. The cartridge also comprises a force receiving portion receiving a force from the photosensitive member unit for releasing an engagement between the developing unit and the engaging portion to move the separation member to the second position when the developing unit is moved relatively with respect to the photosensitive member unit.

BRIEF DESCRIPTION OF THE DRAWINGS

FIG. 16 is a side view of a charging roller separation member according to a fourth embodiment.

DETAILED DESCRIPTION OF THE EMBODIMENTS

First Embodiment

Figure 1:
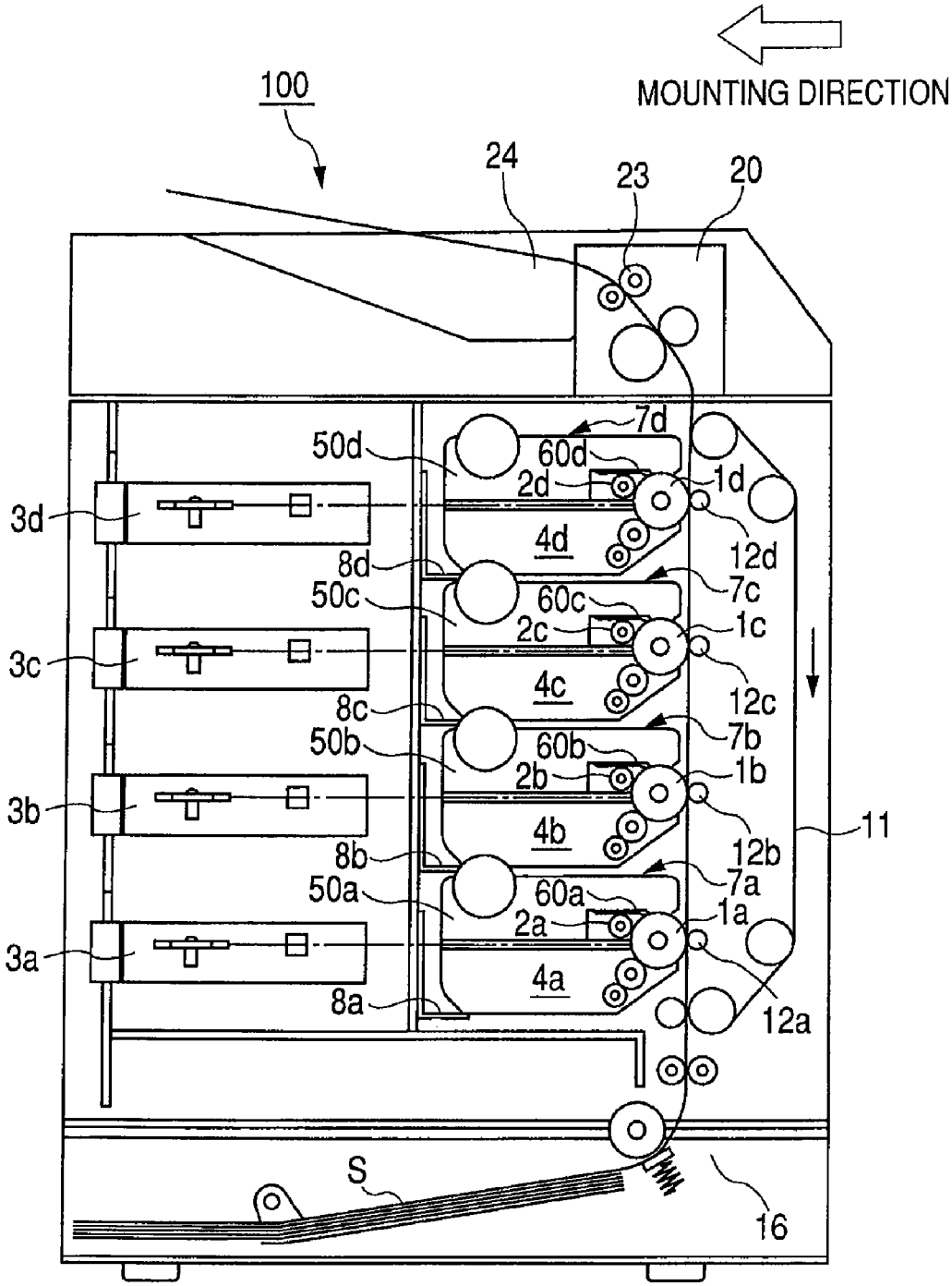
FIG. 1 is an overall schematic view of an image forming apparatus according to a first embodiment.
Figure 2:
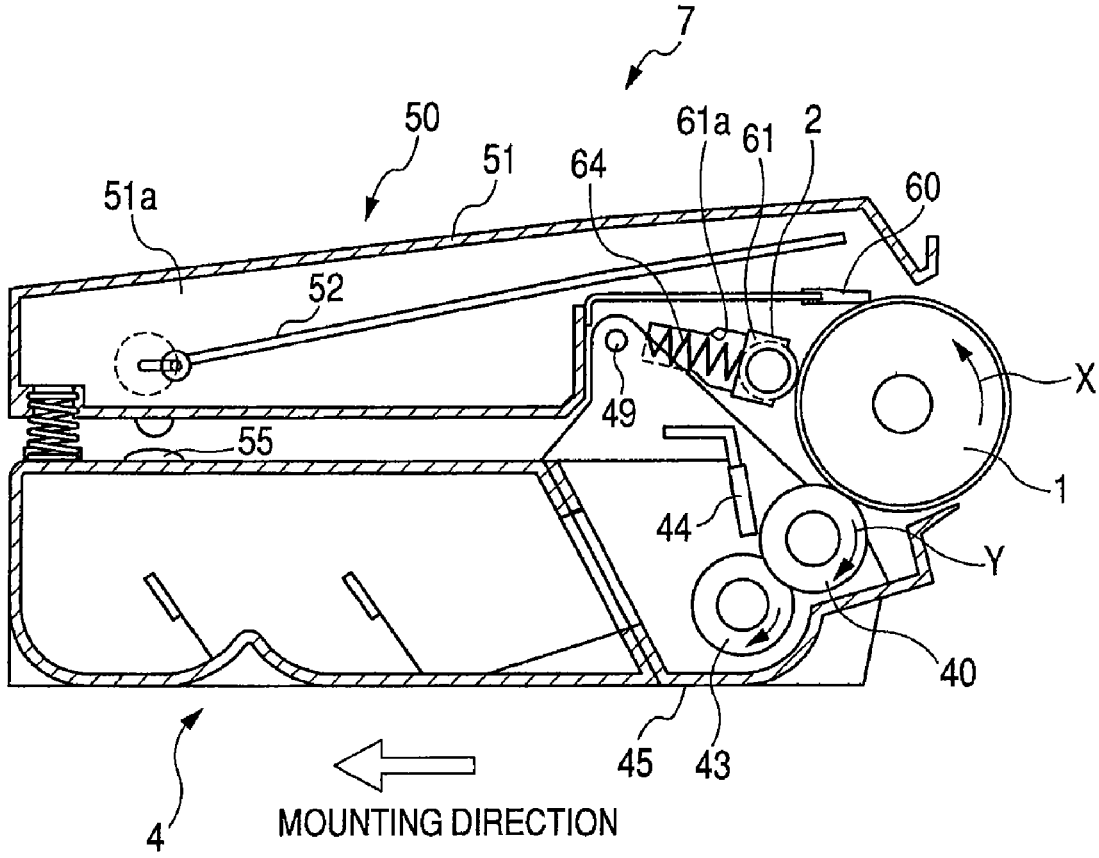
FIG. 2 is a sectional schematic view of a process cartridge.
Figure 3:
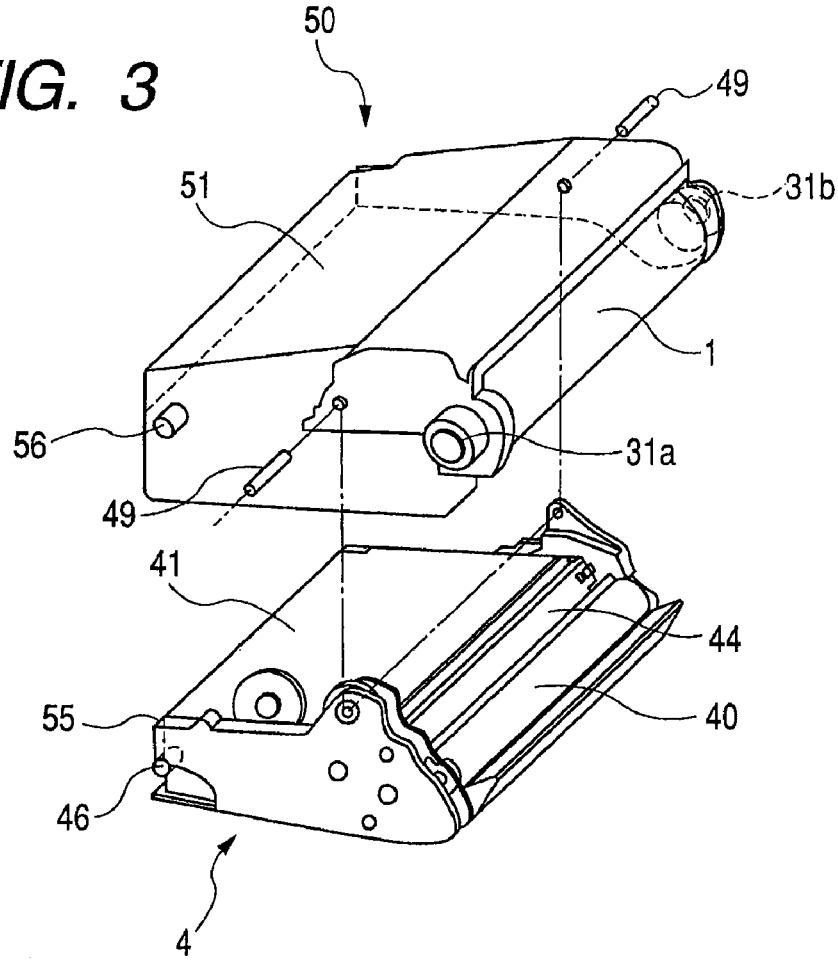
FIG. 3 is a perspective view illustrating a connection construction of the process cartridge.

A first exemplary embodiment of a process cartridge and an image forming apparatus according to the present invention will be described referring to the drawings. FIG. 1 is an overall schematic view of a color electrophotographic image forming apparatus according to this embodiment. FIG. 2 is a sectional explanatory view of a process cartridge. FIG. 3 is a perspective view illustrating a connection construction of the process cartridge.

(Overall Construction of an Image Forming Apparatus)

First, the overall construction of the image forming apparatus will be described with reference to FIGS. 1 and 2. As illustrated in FIG. 1, an image forming apparatus main body 100 includes four process cartridge mounting portions (8*a*, 8*b*, 8*c*, and 8*d*) arranged side-by-side in the vertical direction.

A cartridge 7 (7*a*, 7*b*, 7*c*, 7*d*) that is mounted at each mounting portion includes a photosensitive drum (electrophotograpic photosensitive member) 1 (1*a*, 1*b*, 1*c*, 1*d*), being an image bearing member. Around the photosensitive drum 1, there are arranged in the order of mention in a rotation direction of the photosensitive drum 1, a charging roller 2 (2*a*, 2*b*, 2*c*, 2*d*), a scanner unit (3*a*, 3*b*, 3*c*, 3*d*), a developing unit 4 (4*a*, 4*b*, 4*c*, 4*d*), a transfer roller (12*a*, 12*b*, 12*c*, 12*d*), and a cleaning blade 60 (60*a*, 60*b*, 60*c*, 60*d*).

As illustrated in FIG. 2, the charging roller 2 serving as a charging member is abutted on the surface of the photosensitive drum 1 to uniformly charge the surface of the photosensitive drum 1. The scanner unit (3*a*, 3*b*, 3*c*, 3*d*) applies a laser beam according to image information to form an electrostatic latent image on the photosensitive drum 1. The developing unit 4 develops the electrostatic latent image using a toner, being a developer to form a visible image (toner image). The transfer roller (12*a*, 12*b*, 13*c*, 12*d*) is an electrostatic transfer unit causing the toner image on the photosensitive drum 1 to be transferred on a recording sheet S. The cleaning blade 60 is a cleaning unit removing the toner remaining on the surface of the photosensitive drum 1 after a transfer process.

An image forming operation in the above-mentioned image forming apparatus will be as follows.

First, the process cartridge 7 is sequentially driven in accordance with the timing of an image formation. Responsive to the driving of the process cartridge 7, the photosensitive drum 1 is driven to rotate in the direction indicated by an arrow X (in a counterclockwise direction in FIG. 2). Then, the scanner unit (3*a*, 3*b*, 3*c*, 3*d*) corresponding to each process cartridge (7*a*, 7*b*, 7*c*, 7*d*) is driven in sequence, and the charging roller 2 applies a uniform electric charge on the surface of the photosensitive drum 1. The scanner unit (3*a*, 3*b*, 3*c*, 3*d*) exposes the surface of the photosensitive drum 1 to light modulated according to an image signal to form an electrostatic latent image on the photosensitive drum 1. The electrostatic latent image having been formed is developed by a developing roller (developing member) 40.

On the other hand, the recording sheet S having been fed from a feeding portion 16 is conveyed between each photosensitive drum 1 and its associated transfer roller (12*a*, 12*b*, 12*c*, 12*d*) by a transfer belt 11, and a toner image of each photosensitive drum 1 is sequentially transferred thereto. The recording sheet S having been transferred with the toner images of the four colors is separated from the transfer belt 11 and conveyed to a fixing portion 20. The recording sheet S having been conveyed to the fixing portion 20, after the toner image has been fixed by heating, is discharged out of the main body from a discharge portion 24 by a discharge roller 23.

(Process Cartridge)

Now, the process cartridge 7 will be described. In this embodiment, the process cartridges 7*a* to 7*d* have the same construction. The process cartridges 7*a* to 7*d* contain toners of yellow, magenta, cyan and black, respectively.

As illustrated in FIGS. 2 and 3, the process cartridge 7 (7*a* to 7*d*) is constructed to be an integral cartridge into which the photosensitive member unit 50 (50*a* to 50*d*) and the developing unit 4 (4*a* to 4*d*) are incorporated.

The photosensitive member unit 50 includes the photosensitive drum 1, the charging roller 2, the cleaning blade 60, a photosensitive member frame 51, and a removed toner chamber 51*a*. The photosensitive drum 1 is rotatably attached to the photosensitive member frame 51 via bearings 31*a*, 31*b*. The removed toner chamber 51*a* is provided at the rear of the photosensitive member frame 51. The remaining toner having been removed by the cleaning blade 60 is fed to the removed toner chamber 51*a* by a toner feed mechanism 52.

The developing unit 4 includes a developing roller 40 and a developing frame 45. A toner containing portion 41 is provided in the developing frame 45. Each toner containing portion 41 contains a toner of the color the cartridge stores in the developing frame 45, the developing roller 40 is rotatably supported so as to be opposed to the photosensitive drum 1.

There are disposed on the circumference of the developing roller 40 a toner feed roller 43 and a developing blade 44. The developing roller 40 is rotated in the direction indicated by an arrow Y (refer to FIG. 2) in contact with the photosensitive drum 1 to carry and convey the toner.

As illustrated in FIG. 3, the developing unit 4 is pivotally coupled to the photosensitive member unit 50 with a developing unit pivot shaft 49 being a pivot center. The developing unit 4 can be relatively moved (can be pivoted) with respect to the photosensitive member unit 50.

The developing unit 4 is urged with the pivot shaft 49 being the center such that the developing roller 40 is contacted with the photosensitive drum 1.

(Mounting of the Process Cartridge onto the Image Forming Apparatus Main Body)

Figure 4:
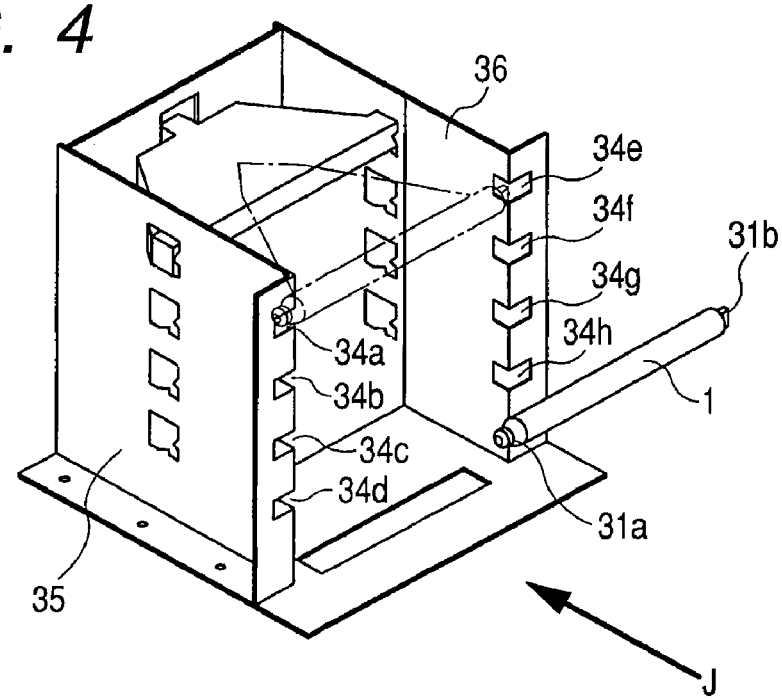
FIG. 4 is a perspective view illustrating a mounting of the process cartridge onto the image forming apparatus main body.

Now, mounting of the process cartridge 7 onto the apparatus main body 100 will be described. FIG. 4 is a perspective view of the apparatus main body 100 when the process cartridge 7 is mounted on the apparatus main body 100.

The process cartridge 7 is detachably mountable to the image forming apparatus main body. As illustrated in FIG. 4, the process cartridge 7 is mounted in the direction indicated by an arrow J with respect to the apparatus main body 100. Then, the bearings 31 (31*a* and 31*b*) that support the photosensitive drum 1 are inserted along guide grooves 34*a* to 34*h* of the apparatus main body 100. Further, owing to the bearings 31 being pressed against the guide grooves 34, the position of the process cartridge 7 with respect to the apparatus main body 100 is determined.

(Developing Separation Construction of the Process Cartridge)

Now, the separation construction between the photosensitive drum 1 and the developing roller 40 in the process cartridge 7 will be described using FIGS. 3, 4, 5A and 5B.

The photosensitive member unit 50 includes regulating portions 56 on both side faces, and the apparatus main body 100 includes engaging portions 85 on both side plates 35 and 36. In the state in which the process cartridge 7 is inserted in the apparatus main body 100, the engaging portion 85 is engaged with the regulating portion 56 to regulate the upward movement of the photosensitive member unit 50.

There is provided integrally at the rear of the developing unit 4 (on the toner conveying upstream side of the toner containing portion 41) a force receiving portion 46. The apparatus main body 100 includes a cam 80 serving as a separation unit. At the rear of the developing unit 4, between the photosensitive member unit 50 and the developing unit 4, there is provided a spring 54, being an urging member. The spring 54 provides an urging force between the photosensitive member unit 50 and the developing unit 4 so as to urge the developing roller 40 to the photosensitive drum 1. That is, the spring 54 urges the rear side of the developing unit 4 in the direction of being separated from the photosensitive member frame 51.

Figure 5A:
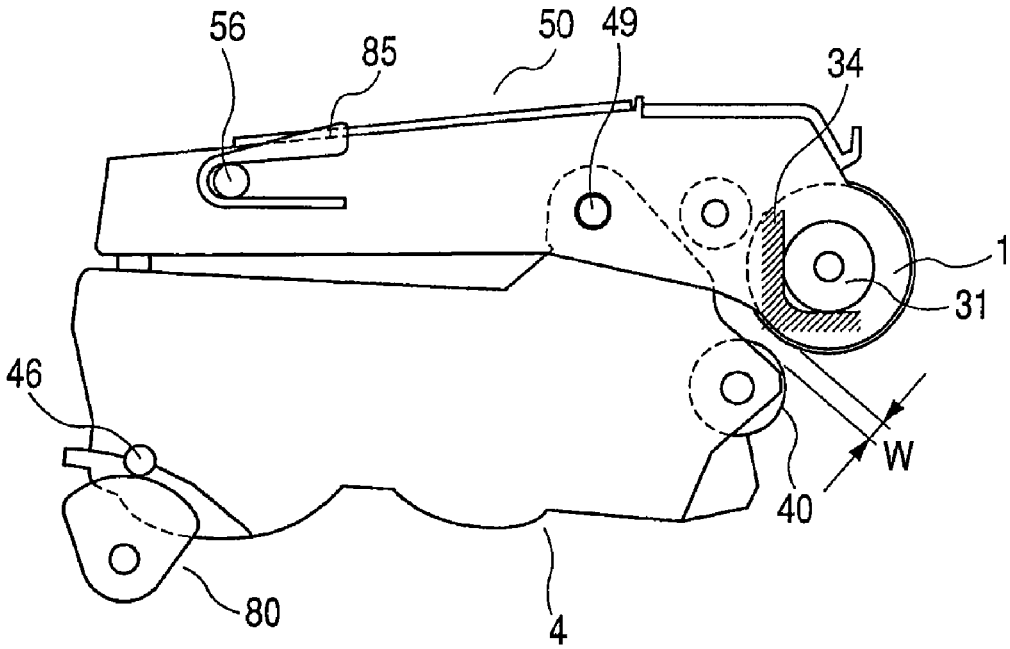
FIG. 5A is a sectional view illustrating mounting of the process cartridge onto the image forming apparatus main body in the state in which a developing roller is separated from a photosensitive drum.

As illustrated in FIG. 5A, due to the rotation of the cam 80 to push the force receiving portion 46 up, the developing unit 4 is rotated about the pivot shaft 49. Then, the developing roller 40 is brought in the state of being separated from the photosensitive drum 1 by a predetermined gap W.

Figure 5B:
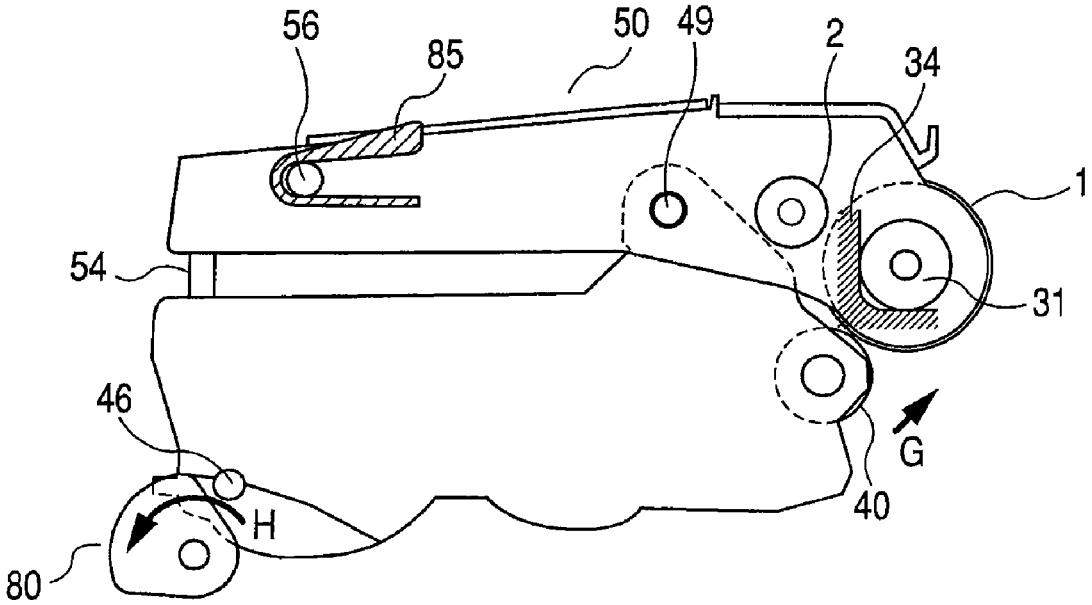
FIG. 5B is a sectional view illustrating mounting of the process cartridge onto the image forming apparatus main body in the state in which the developing roller is abutted on the photosensitive drum.

As illustrated in FIG. 5B, at the time of forming an image, by the rotation of the cam 80 in the direction indicated by an arrow H, the pressure on the force receiving portion 46 is released, and the developing unit 4 is rotated about the pivot shaft 49. Then, the developing roller 40 and the photosensitive drum 1 abut against each other at a predetermined pressure.

Now, the construction of developing separation in the state before the cartridge is mounted on the image forming apparatus main body will be described with reference to FIGS. 6A and 6B.

Figure 6A:
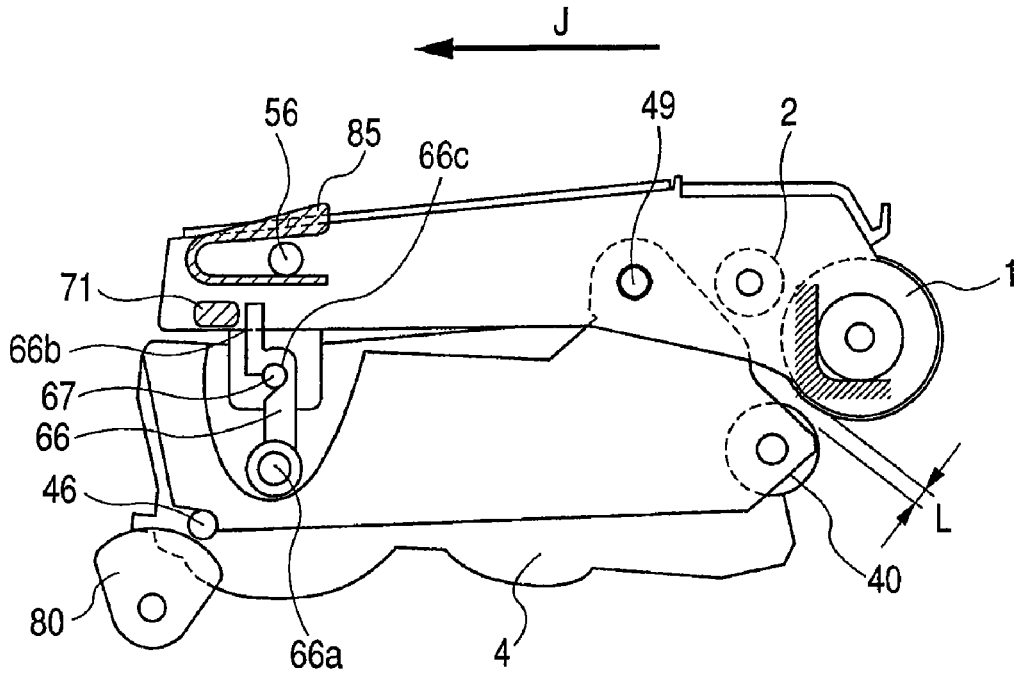
FIG. 6A is a sectional view illustrating mounting of the process cartridge in which the engagement of a separation hook is made, onto the image forming apparatus main body.
Figure 6B:
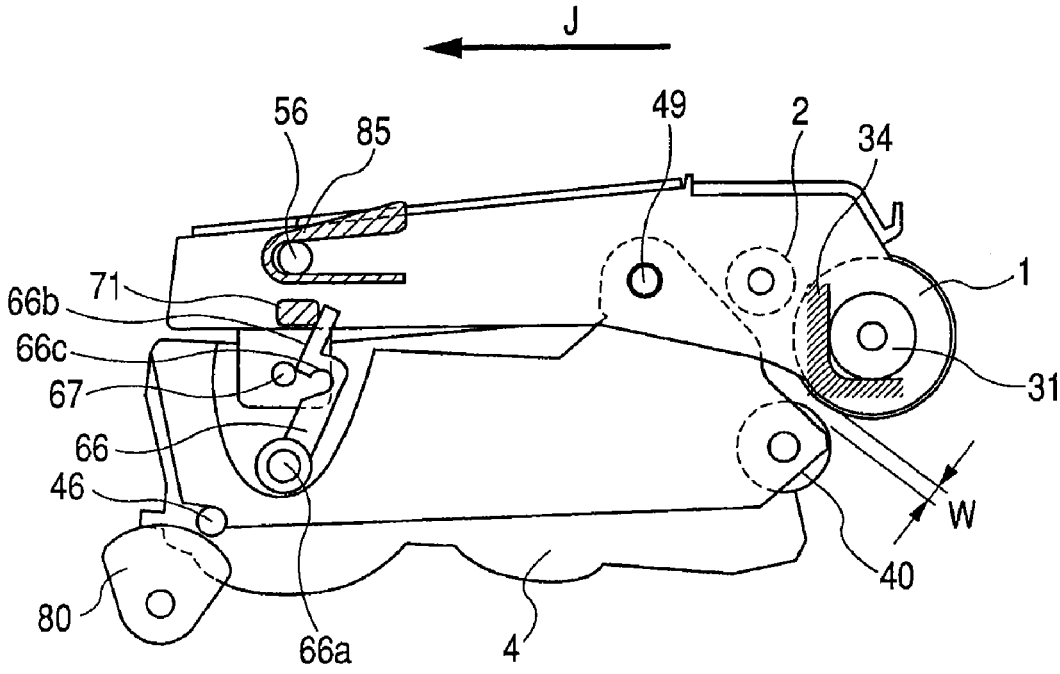
FIG. 6B is a sectional view illustrating the releasing the engagement of the separation hook.

As illustrated in FIGS. 6A and 6B, the developing unit 4 is provided with a separation hook 66 pivotally about a pivot shaft 66*a*. There are provided at the distal end of the separation hook 66 a convex portion 66*b* and a concave portion 66*c*. There is provided at the photosensitive member frame 51 a protrusion 67 to be engaged with the concave portion 66*c*.

As illustrated in FIG. 6A, in the state in which the process cartridge 7 is not used (new one), the process cartridge 7 is shipped in the state in which the concave portion 66*c* is engaged with the protrusion 67, being in the state in which the developing roller 40 is separated from the photosensitive drum 1 by a predetermined gap L. Here, the position of the developing unit 4 in the state in which the developing roller 40 and the photosensitive drum 1 are separated is referred to as a separation position.

As illustrated in FIG. 6B, when the process cartridge 7 is mounted on the image forming apparatus main body 100, a protrusion 71 that is provided at the image forming apparatus main body 100 is abutted on the convex portion 66*b*, and the separation hook 66 is rotated about the pivot shaft 66*a*. As a result, the engagement between the concave portion 66*c* and the protrusion 67 is released. With the arrangement, the developing roller 40 and the photosensitive drum 1 are brought into contact with each other. Here, the position of the developing unit 4 in the state in which the developing roller 40 and the photosensitive drum 1 are contacted with each other is referred to as a contact position.

Now, the separation construction of the charging roller 2 will be described.

(Charging Roller)

Figure 7:
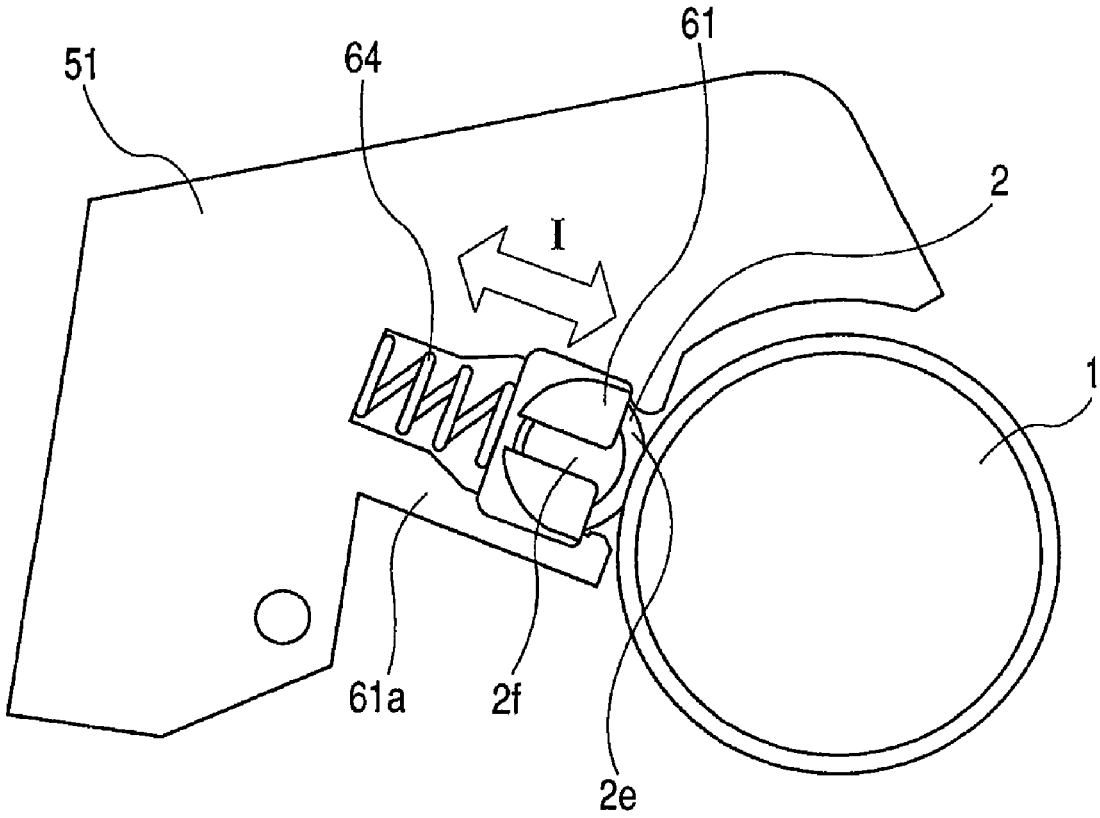
FIG. 7 is a partial sectional view of the process cartridge illustrating a charging roller.

First, the charging roller 2 and the support construction of the charging roller 2 will be described. FIG. 7 is a partially sectional view of the process cartridge 7 looking from the side face in the axial direction of the charging roller 2. As illustrated in FIG. 7, the charging roller 2 is constructed to be formed with a conductive rubber member (elastic layer) 2*e* around a cored bar (shaft portion) 2*f*. The charging roller 2 is rotatably supported by a bearing 61. The bearing 61 is supported in a guide portion 61*a* of the photosensitive member frame 51. That is, the photosensitive member frame 51 rotatably supports the charging roller 2. The bearing 61 can slide in the guide portion 61*a*, and the charging roller 2 can be moved in directions indicated by a two-headed arrow I in FIG. 7 (in the directions of being abutted or separated with respect to the photosensitive drum 1). That is, the charging roller 2 can be moved between the abutment position of being abutted on the photosensitive drum 1 and the separation position of being separated from the photosensitive drum 1. The charging roller 2 is pressed against the photosensitive drum 1 by a compression spring (urging member) 64 via the charging roller bearing 61.

(Charging Roller Separation Member)

Figure 8:
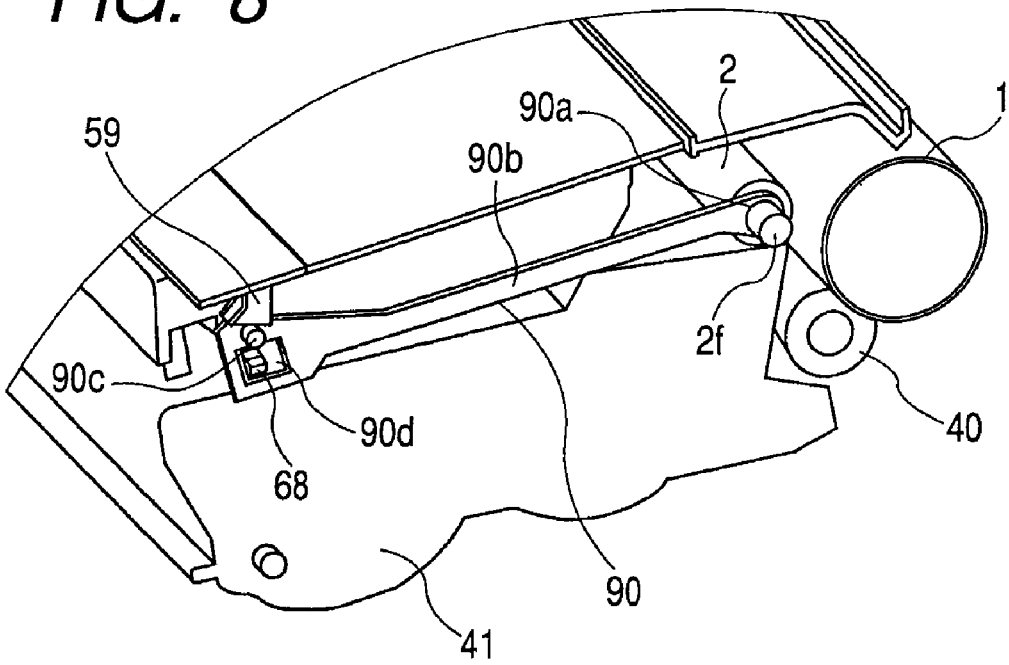
FIG. 8 is a partially sectional perspective view of the process cartridge illustrating a charging roller separation member.
Figure 10:
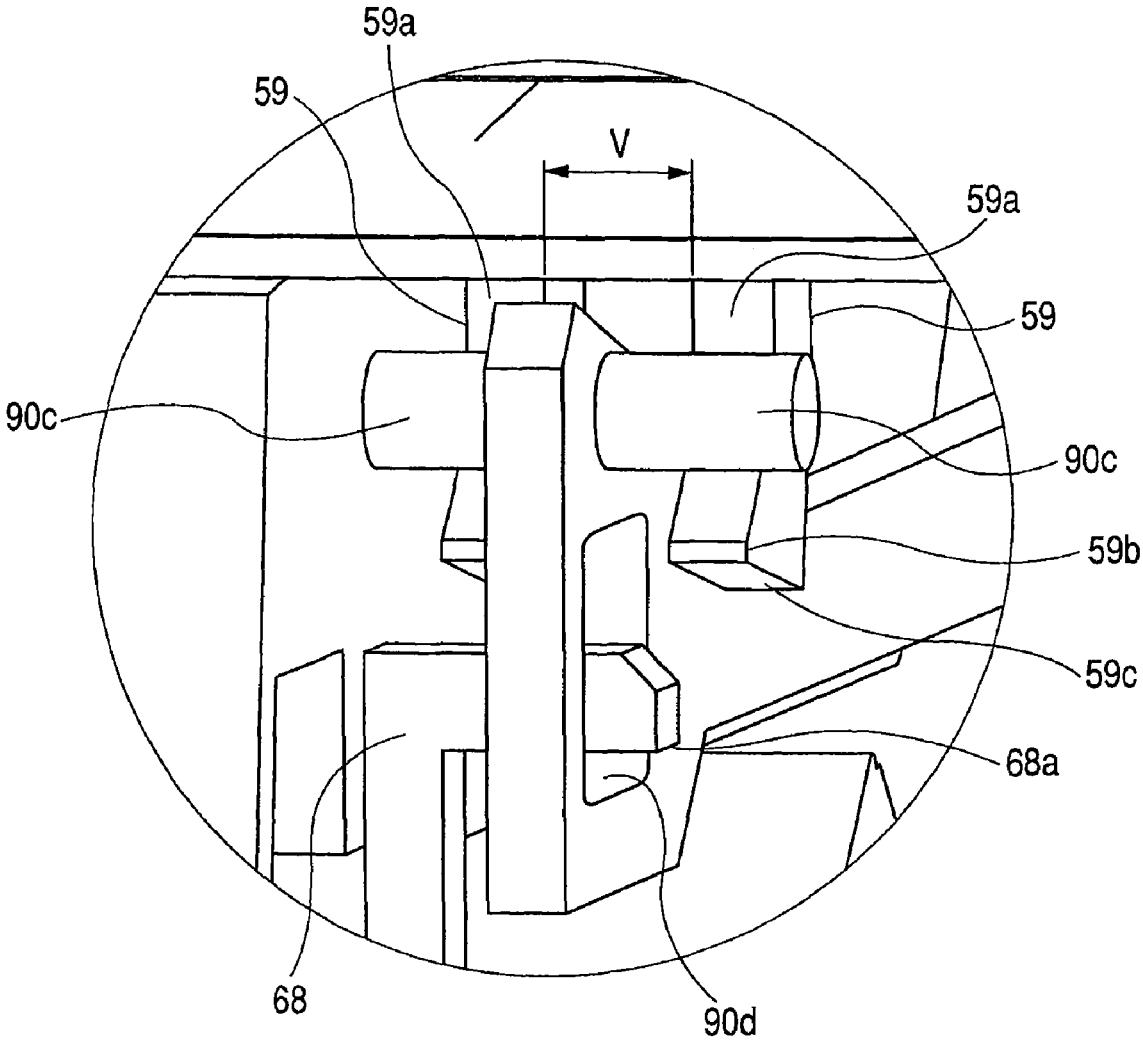
FIG. 10 is a partial perspective view of the charging roller separation member.

A charging roller separation member 90 of making a separation of the charging roller 2 will be described. FIG. 8 is a sectional perspective view at one end portion (in the vicinity of a bearing support) of the charging roller 2. FIG. 10 is a partial perspective view at one end portion of the separation member 90. Incidentally, in this embodiment, although one end portion of the charging roller 2 will be described as a matter of convenience, the charging roller 2 is in the same construction at both end portions.

As illustrated in FIG. 8, the separation member 90 includes a shaft holding portion 90*a* at one end of a connection portion 90*b*, and includes a protrusion 90*c* serving as an engaging portion and a release hole 90*d* serving as a force receiving portion, at the other end. At the underside of the photosensitive member frame 51, a hook portion 59 serving as an engaged portion is hung down. That is, the hook portion 59 is a part of the photosensitive member frame 51. In addition, at the toner containing portion 41, a hook portion 68 serving as a force applying portion is erected. That is, the hook portion 68 is a part of the developing frame 45.

The shaft holding portion 90*a* holds the cored bar 2*f* of the charging roller 2.

The protrusion 90*c* is formed to be in the same convex shape on both side faces of the separation member 90, and can be engaged with the hook portion 59. The protrusion 90*c* is held in the photosensitive member frame 51 in the state of being engaged with the hook portion 59.

As illustrated in FIG. 10, the release hole 90*d* is formed to be a hole through which a claw 68*a* of the hook portion 68 passes, and which can be engaged with the hook portion 68.

The separation member 90 can be moved between the first position in which the charging roller 2 is held in the state of being separated from the photosensitive drum 1 and the second position in which the charging roller 2 is abutted on the photosensitive drum 1.

The hook portion 59, by the engagement with the protrusion 90*c*, holds the separation member 90 in the first position. As a result, the state in which the charging roller 2 is separated from the photosensitive drum 1 is maintained. At this time, the separation member 90 is positioned in the first position against the urging force of the compression spring 64. Further, the hook portion 68, when the developing unit 4 is pivoted (that is, the developing unit is relatively moved with respect to the photosensitive member unit 50), presses the release hole 90*d*. In other words, force is applied to the release hole 90*d* from the hook portion 68. As a result, the separation member 90 is released from being held by the hook portion 59. As a result, the separation member 90 is moved to the second position. That is, the separation member 90 is in the state of being at least engaged with the hook portion 59 in the first position, and in the state of being disengaged from the hook portion 59 in the second position.

(Construction of Holding Separation of the Charging Roller)

Figure 9:
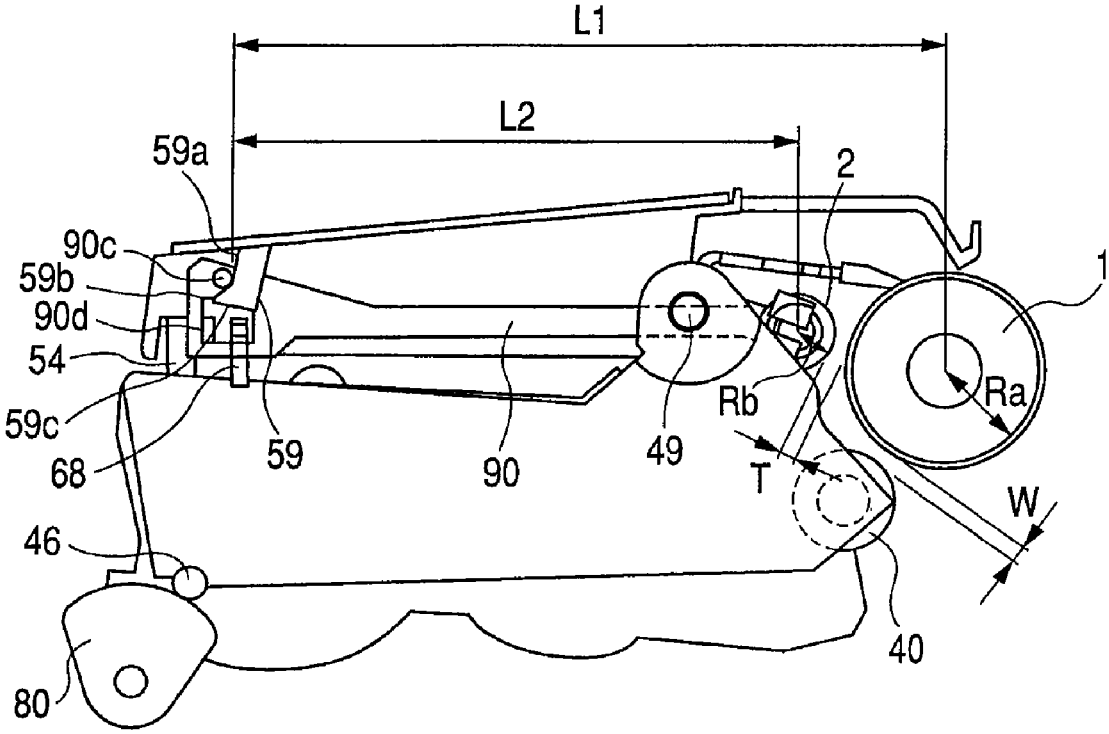
FIG. 9 is a sectional view of the process cartridge.

Now, the construction of maintaining the separation of the charging roller 2 will be described. FIG. 9 is a sectional view of the process cartridge 7 in the state in which the developing roller 40 and the charging roller 2 are separated from the photosensitive drum 1.

As illustrated in FIG. 9, the hook portion 59 includes a holding portion 59*a*, a hooking portion 59*b* and a slide portion 59*c*.

The holding portion 59*a* is a face for holding the separation member 90. The hooking portion 59*b* is formed upward at the lower end of the hook portion 59 and hooks the protrusion 90*c* to hold the separation member 90. The slide portion 59*c* is a face inclined diagonally upward such that the protrusion 90*c* can slide in contact therewith.

As illustrated in FIG. 10, the hook portion 59 is disposed at two points with a space V therebetween in the longitudinal direction of the process cartridge 7. The other end of the separation member 90 can move between two hook portions 59 disposed with the space V therebetween.

The separation member 90 is pulled in the separation direction to separate the charging roller 2 from the photosensitive drum 1. Owing to the hooking of the protrusion 90*c* on the hook portion 59 to be engaged in this state (in the first position), the charging roller 2 is held in the separation state in which the charging roller 2 is separated from the photosensitive drum 1.

A separation amount T between the photosensitive drum 1 and the charging roller 2 is determined by a distance L2 between an outer diameter portion of the protrusion 90*c* and the center of the charging roller, a distance L1 between the center of the photosensitive drum 1 and the holding portion 59*a*, a radius Ra of the photosensitive drum 1, and a radius Rb of the charging roller 2.

(Construction of Releasing the Charging Roller from being Held in Separation)

Figure 11A:
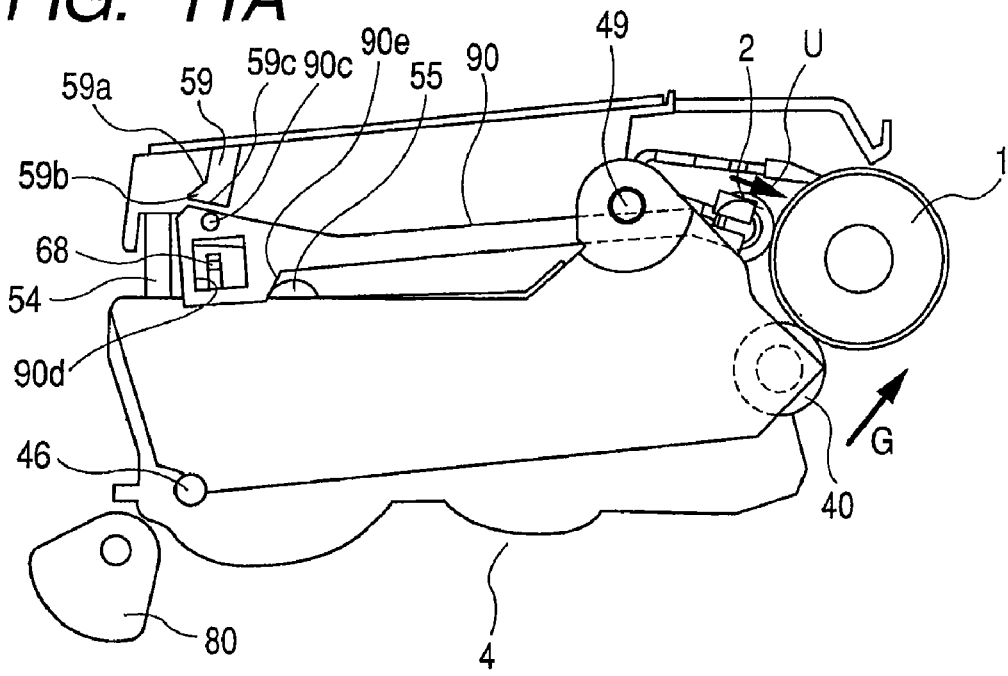
FIGS. 11A and 11B are sectional views of the process cartridge.
Figure 11B:
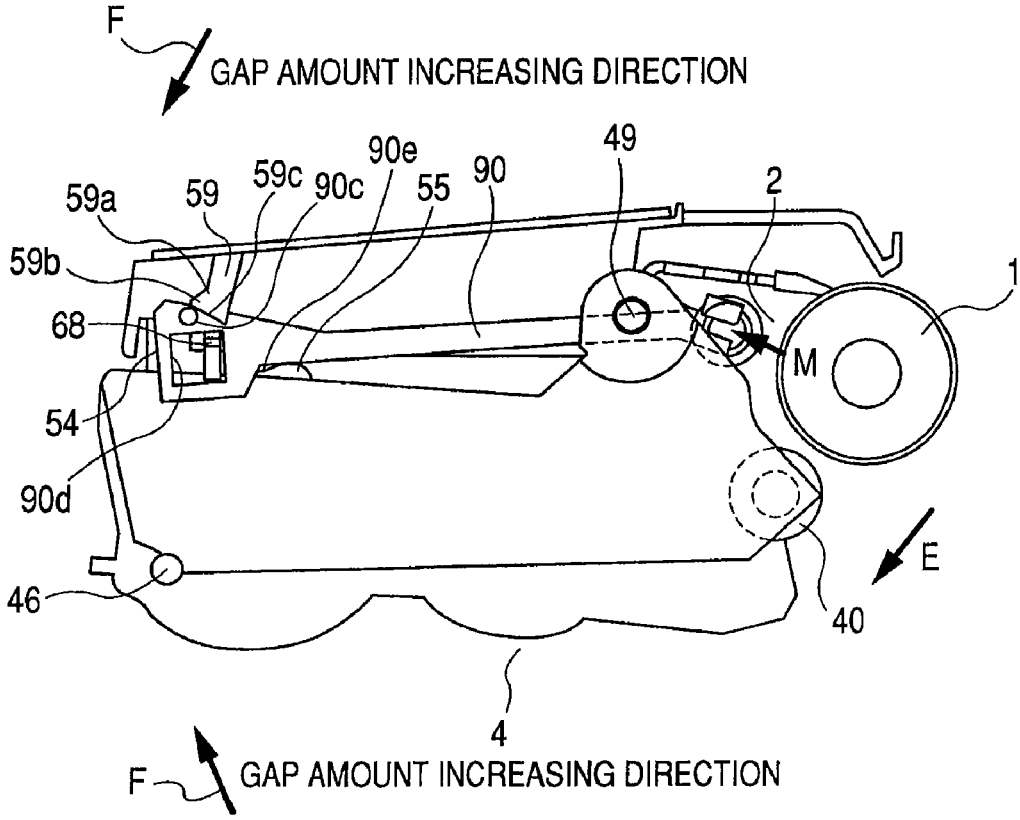
Figure 12:
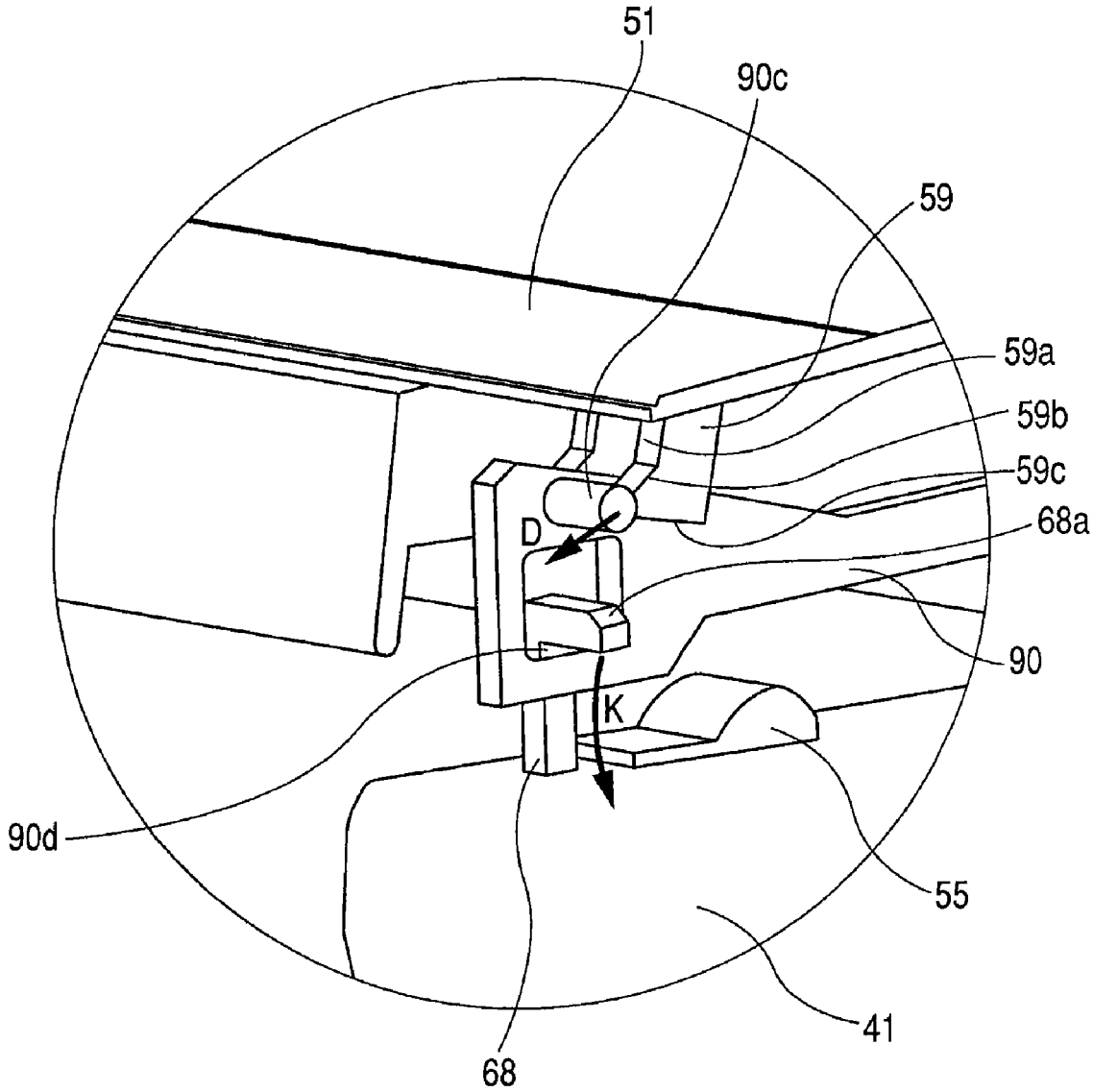
FIG. 12 is a partial perspective view of the charging roller separation member.

Now, the construction of releasing the separation state of the charging roller will be described. FIGS. 11A and 11B are explanatory views of the method of releasing the separation state of the charging roller. FIG. 12 is a partial perspective view of the separation member 90 and the toner containing portion 41.

In the separation state of the charging roller 2, the protrusion 90*c* is hooked on the hook portion 59 to be engaged.

When the toner containing portion 41 is rotated in the direction indicated by an arrow G in FIG. 11A about the pivot shaft 49, the developing roller 40 is contacted with the photosensitive drum 1 to be brought into the abutment state from the separation state.

In association with this pivotal movement of the toner containing portion 41 in the direction indicated by the arrow G, the hook portion 68 is rotated in the direction indicated by an arrow K in FIG. 12. Owing to the rotation of the hook portion 68, the claw 68*a* is engaged with the release hole 90*d*. The claw 68*a* that is engaged with the release hole 90*d* is further rotated in the direction indicated by the arrow K. As a result, the claw 68*a* presses the release hole 90*d* in the direction indicated by the arrow K, and force is applied to the release hole 90*d* in the direction indicated by the arrow K.

With this arrangement, the protrusion 90*c* is moved in the direction indicated by an arrow D in FIG. 12 from the holding portion 59*a*, gets over the hooking portion 59*b*, and releases the engagement between the separation member 90 and the hook portion 59. In the state in which the engagement is released, the separation member 90 and the charging roller 2 are moved in the direction of being abutted on the photosensitive drum 1 by the urging force provided by the compression spring 64, and thus the charging roller 2 and the photosensitive drum 1 are brought into contact with each other at a predetermined pressure. At this time, the separation member 90 is in the second position.

(Construction of Separating the Charging Roller 2 Again)

Next, in the case where the charging roller 2 needs to be separated again, the separation member 90 is returned to the first position from the second position, and thus the charging roller 2 and the photosensitive drum 1 are separated from each other and held in the separation state.

As illustrated in FIG. 11A, the developing unit 4 includes a protrusion 55 in the position of being opposed to the separation member 90. The separation member 90 is provided with a receiving face 90*e* that can abut on the protrusion 55. The protrusion 55 is formed in the position of not pushing the separation member 90 up even if the developing unit 4 is rotated by the cam 80.

In the above-mentioned construction, for example, as illustrated in FIG. 11B, the process cartridge 7 is removed from the image forming apparatus main body, and the rear side of the process cartridge is pressed (in the directions indicated by the arrows F). As a result, the developing unit 4 is rotated more than usual with respect to the photosensitive member unit 50, and the separation amount between the photosensitive drum 1 and the developing roller 40 is made to be larger than normal.

Here, the rear side of the process cartridge is the side opposed to the photosensitive drum side with respect to the pivot shaft 49 as the pivot center. Furthermore, a normal separation amount is the separation amount between the developing roller 40 and the photosensitive drum 1 when the developing unit 4 is rotated by the cam 80.

When the separation amount is made larger than normal, the protrusion 55 serving as a return portion applies a force to the receiving face 90*e* of the separation member 90, and pushes up the separation member 90. When the separation member 90 is pushed up, the protrusion 90*c* is abutted on the slide portion 59*c*.

From this state, the developing unit 4 is rotated in the direction of separating the developing roller 40 further. As a result, the protrusion 90*c* is moved along the slide portion 59*c*, and the separation member 90 is moved in the separation direction. With this arrangement, the charging roller 2 is moved in the direction indicated by an arrow M in FIG. 11B, and separated from the photosensitive drum 1.

Thereafter, the protrusion 90*c* gets over the hooking portion 59*b* of the hook portion 59, and held in the position of being abutted on the holding portion 59*a*. That is, the separation member 90 is returned to the first position, and the charging roller 2 is held in the separation sate of being separated with respect to the photosensitive drum 1 by the predetermined separation amount T again.

(Advantage)

In the above-described construction, before use, the separation of a predetermined distance of the charging roller from the photosensitive drum 1 can be maintained, and in use, the separation state of the charging roller can be released without an increase in the burden on a user.

More specifically, at the time of shipment of the process cartridge, the separation member 90 and the hook portion 59 are brought in the state of being engaged with each other. As a result, the charging roller 2 is held in the state of being separated with respect to the photosensitive drum 1 (in the first position). Therefore, an uneven image due to a permanent deformation of the rubber member 2*e* or the generation of streaks traversing an image of a roller cycle due to rubbing or sliding between the photosensitive drum 1 and the charging roller 2 by the vibration in a physical distribution can be reduced.

In use of the process cartridge, the engagement between the separation member 90 and the hook portion 59 is released by the pivotal movement of the developing unit 4 accompanied by an abutment movement of the developing roller 40. Therefore, without troubling a user, the charging roller 2 is released from being held in separation, and thus the charging roller 2 can be abutted on the photosensitive drum 1.

Second Embodiment

Figure 13:
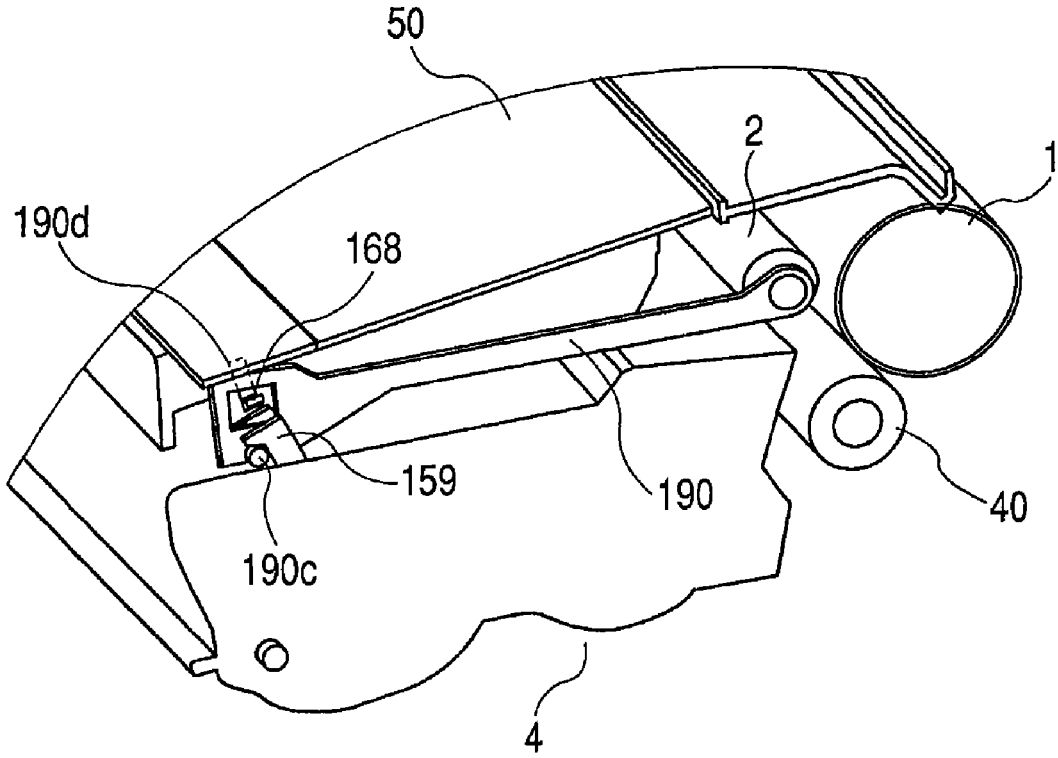
FIG. 13 is a side view of a charging roller separation member according to a second embodiment.

Now, a second embodiment of a process cartridge and an image forming apparatus according to the present invention will be described referring to the drawings. FIG. 13 is a schematic side view of a separation member according to this embodiment. Portions which description is a duplication of that of the above-mentioned first embodiment will be designated with like reference numerals to omit descriptions thereof.

As illustrated in FIG. 13, in the process cartridge and the image forming apparatus according to this embodiment, there are provided a charging roller separation member 190 and hook portions 159, 168 instead of the separation member 90 and the hook portions 59, 68 according to the above-mentioned first embodiment.

In the separation member 190, the protrusion 90*c* and the release hole 90*d* of the separation member 90 are inverted in position. That is, on the underside of the photosensitive member frame 51, the hook portion 168 is hung down. In addition, on the toner containing portion 41, the hook portion 159 is erect. Further, the protrusion 55 according to the first embodiment is also provided at the photosensitive member frame 51 (not illustrated).

In the above-mentioned construction, by the engagement between the hook portion 159 and the protrusion 190*c* of the separation member 190, the separation member 190 is held in the first position, being the state in which the charging roller 2 and the photosensitive drum 1 are separated. Moreover, by the pivotal movement of the developing unit 4, the engagement between the protrusion 190*c* and the hook portion 159 is released by the hook portion 168, thus enabling to be in the second position, being the state in which the charging roller 2 and the photosensitive drum 1 are abutted on each other.

Owing to such construction as described above, the same advantage as is the above-mentioned first embodiment can be obtained.

Third Embodiment

Figure 14A:
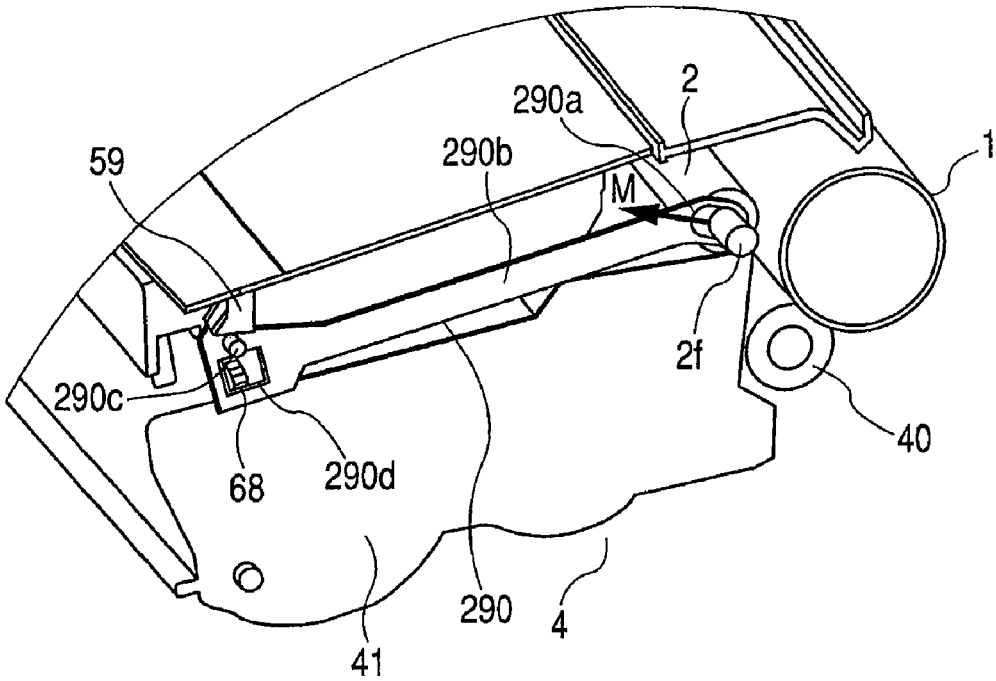
FIG. 14A is a partial sectional, perspective view illustrating a charging roller separation member according to a third embodiment.
Figure 14B:
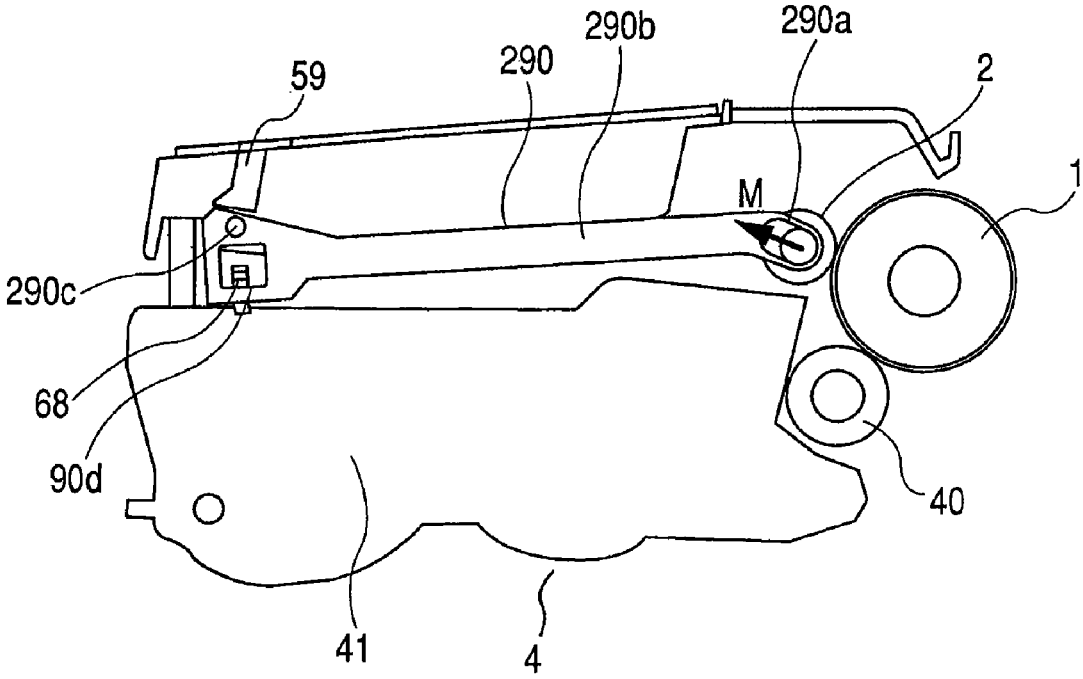
FIG. 14B is a sectional view illustrating the charging roller separation member according to the third embodiment.

Now, a third embodiment of a process cartridge and an image forming apparatus according to the present invention will be described referring to the drawings. FIGS. 14A and 14B are schematic side views of a charging roller separation member according to this embodiment. Portions of the description which duplicate that of the above-mentioned first embodiment will be designated with like reference numerals to omit descriptions thereof.

As illustrated in FIGS. 14A and 14B, the process cartridge and the image forming apparatus according to this embodiment are provided with a charging roller separation member 290 instead of the separation member 90 according to the above-mentioned first embodiment.

Figure 15A:
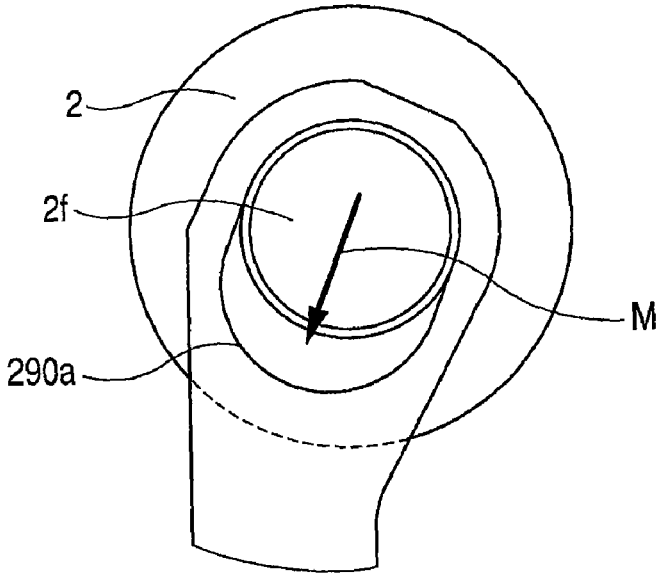
FIG. 15A is a partially enlarged view illustrating a hole shape of a support portion of the charging roller separation member according to the third embodiment.
Figure 15B:
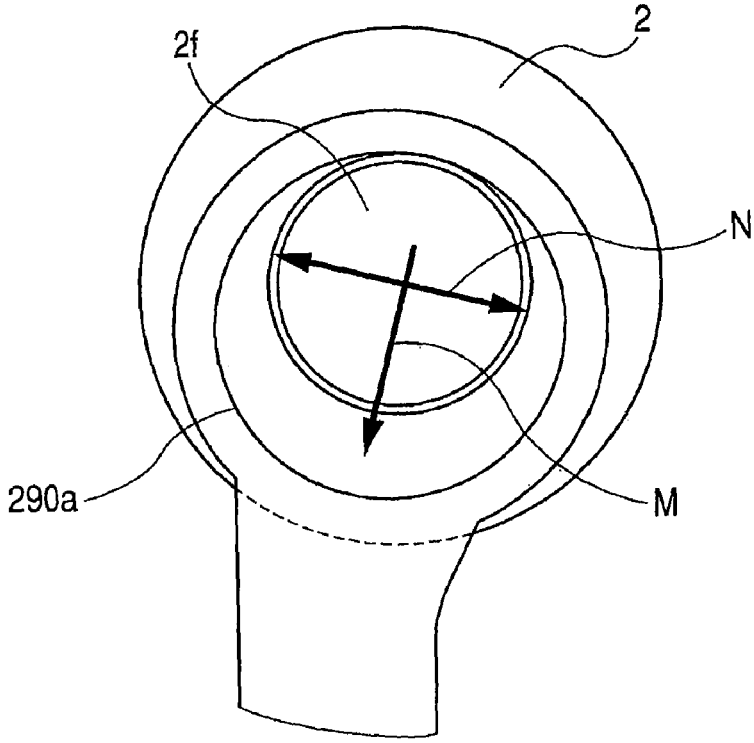
FIG. 15B is a partially enlarged view illustrating a hole shape of a support portion of another charging roller separation member.

As illustrated in FIG. 15A, the separation member 290 is provided with a shaft holding portion 290*a* of an elongated hole shape of elongating the shaft holding portion 90*a* of the separation member 90 in the separation direction (in the direction indicated by an arrow M) opposite to the urging direction of the charging roller 2.

In the case where the process cartridge 7 is applied with an impact in the separation direction (in the direction indicated by the arrow M) in the state in which the charging roller 2 is separated from the photosensitive drum 1, the charging roller 2 is moved in the separation direction as well. However, the cored bar 2*f* is slid in the shaft holding portion 290*a*. As a result, even if the charging roller 2 is moved, release of a protrusion 290*c* of the separation member 290 from the hook portion 59 can be suppressed, and the separation between the charging roller 2 and the photosensitive drum 1 is maintained.

That is, even when the process cartridge 7 is applied with the impact e.g., at the time of physical distribution, the separation state between the charging roller 2 and the photosensitive drum 1 is ensured, thus enabling suppression of the occurrence of the uneven density of an image due to the permanent deformation of the elastic layer of the charging roller 2.

Incidentally, the shape of the shaft holding portion 290*a* is not limited to the above-mentioned rectangular shape, but the shaft holding portion 290*a* has only to include a gap in the direction opposite to the urging direction of urging the charging roller 2 to the photosensitive drum 1 (in the direction indicated by the arrow M). That is, the shaft holding portion 290*a* just has to be so shaped that the cored bar 2*f* can slide in the separation direction in the shaft holding portion 290*a* from the state in which the charging roller 2 is separated from the photosensitive drum 1. For example, as illustrated in FIG.

15B, it has only to be a circular shape larger than the shaft diameter of the charging roller 2.

Since the charging roller 2 is held in a bearing 61, the charging roller 2 is not pivoted in the direction intersected with the urging direction (in the direction indicated by an arrow N). Therefore, originally, the charging roller 2 is never pivoted in the direction intersecting the separation direction. However, in the case where there is looseness or play at the bearing 61 or the mounting portion of the bearing 61, there are some cases of the occurrence of a pivotal movement of this looseness. In this construction, the influence of the charging roller 2 on the separation member 290 owing to this looseness can be reduced. Furthermore, since the gap between the shaft holding portion 290*a* and the charging roller shaft 2*f* can be made larger, the resistance with respect to the movement of following the photosensitive drum 1 of the charging roller 2 by the separation member 290 can be reduced.

Although the separation member 290 according to this embodiment is described instead of the separation member 90 according to the first embodiment, it is applicable instead of the separation member 190 according to the second embodiment.

Fourth Embodiment

Now, a fourth embodiment of a process cartridge and an image forming apparatus according to the present invention will be described referring to the drawings. FIG. 16 is a schematic side view of a charging roller separation member according to this embodiment. Portions of the description that duplicate that of the above-mentioned first embodiment will be designated with like reference numerals to omit descriptions thereof.

As illustrated in FIG. 16, the process cartridge and the image forming apparatus according to this embodiment are provided with a charging roller separation member 390 instead of the charging roller separation member 90 according to the above-mentioned first embodiment.

The separation member 390 includes a shaft holding portion 390*a* of an elongated hole shape of being elongated in the separation direction (in the direction indicated by an arrow M) opposite to the urging direction of urging the charging roller 2 to the photosensitive drum 1, and a regulating portion 390*f* of regulating the movement of the separation member 390 on the occasion of moving in the separation direction. Here, the regulating portion 390*f* is provided so as to be proximate to a regulating portion receiving face 59*d* of a hook portion 59 of the photosensitive member frame 51 when the charging roller 2 is in the state of being separated from the photosensitive drum 1.

There are some cases where the process cartridge 7 is applied with an impact in the separation direction (in the direction indicated by the arrow M) in the state in which the charging roller 2 is separated from the photosensitive drum 1 at the time of physical distribution of the process cartridge. In this case, the charging roller 2 is moved in the separation direction, the cored bar 2*f* is also slid in the shaft holding portion 390*a*, and the separation member 390 will lose the urging force that is provided from the compression spring 64 via the cored bar 2*f*. Then, the separation member 390 that loses the urging force tends to move in the separation direction by the impact as well. On this occasion, by the abutment between the regulating portion 390*f* and the regulating portion receiving face 59*d*, the movement of the separation member 390 in the separation direction can be regulated. Thus, release of a protrusion 390*c* from the hook portion 59 to release the separation between the charging roller 2 and the photosensitive drum 1 is suppressed.

That is, even when the process cartridge 7 is applied with an impact at the time of physical distribution, the separation state between the charging roller 2 and the photosensitive drum 1 is ensured. As a result, the occurrence of an uneven density of an image due to a permanent deformation of the elastic layer of the charging roller 2 can be suppressed.

Incidentally, the regulating portion 390*f* is shaped to include a notch portion 390*g* at each end portion to have elasticity. With this arrangement, in the case of moving from the first position to the second position, due to that the regulating portion 390*f* is bent when the protrusion 390*c* gets over the hooking portion 59*b* of the hook portion 59, the engagement between the separation member 390 and the hook portion 59 can be released.

Incidentally, this embodiment is applicable even if the shaft holding portion 390*a* is not shaped to be an elongated hole. Furthermore, this embodiment is applicable to the second embodiment as well.

Fifth Embodiment

Figure 17:
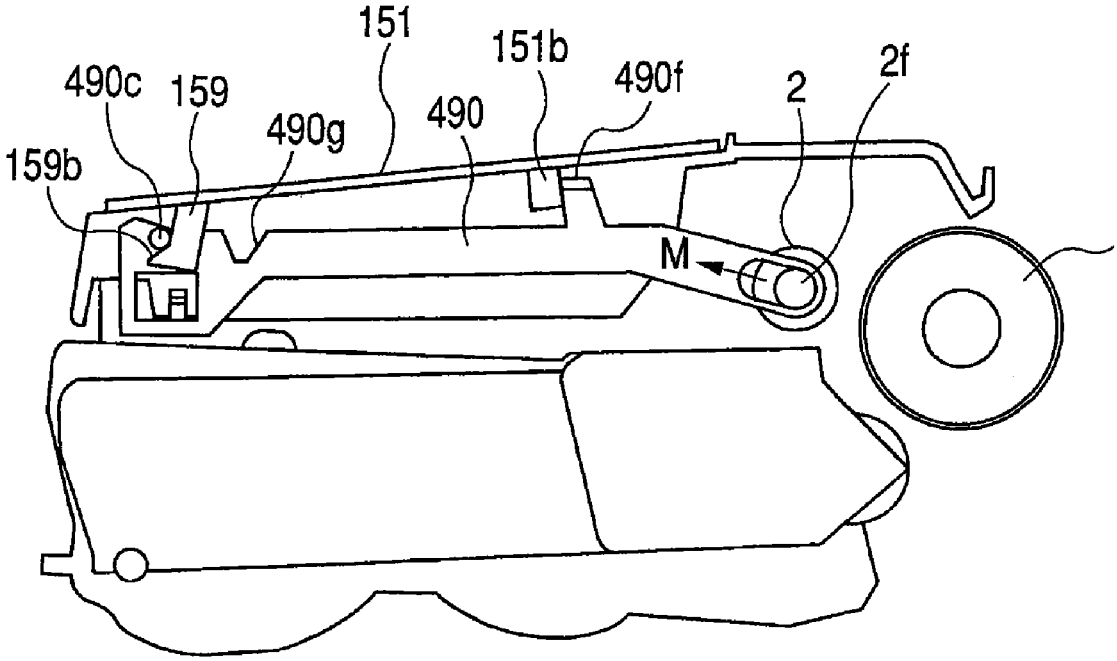
FIG. 17 is a side view of a charging roller separation member according to a fifth embodiment.

Now, a fifth embodiment of a process cartridge and an image forming apparatus according to the present invention will be described referring to the drawings. FIG. 17 is a schematic side view of a charging roller separation member according to this embodiment. Portions of the description which duplicate that of the above-mentioned first embodiment will be designated with like reference numerals to omit descriptions thereof.

As illustrated in FIG. 17, in the process cartridge and the image forming apparatus according to this embodiment, there are provided a cleaning frame 151 instead of the photosensitive member frame 51 according to the above-mentioned first embodiment, and a charging roller separation member 490 instead of the charging roller separation member 90.

In the cleaning frame 151, as illustrated in FIG. 17, there is provided a regulating portion receiving portion 151*b*. In addition, the separation member 490 is provided with a regulating portion 490*f* and a notch portion 490*g*. Here, the regulating portion 490*f* is provided so as to be proximate to the regulating portion receiving portion 151*b* when the charging roller 2 is in the state of being separated from the photosensitive drum 1.

In the case where the process cartridge 7 is applied with an impact in the separation direction (in the direction indicated by the arrow M) in the state in which the charging roller 2 is separated from the photosensitive drum 1 at the time of physical distribution of the process cartridge, the charging roller 2, the cored bar 2*f* and the separation member 490 are applied with the impact in the separation direction as well. On this occasion, by the abutment of the regulating portion 490*f* of the separation member 490 against the regulating portion receiving portion 151*b*, the movement of the charging roller 2, the cored bar 2*f* and the separation member 490 in the separation direction can be regulated. Therefore, release of a protrusion 490*c* from the hook portion 159 to release the separation between the charging roller 2 and the photosensitive drum 1 can be suppressed.

That is, even when the process cartridge 7 is applied with the impact at the time of physical distribution, the separation state between the charging roller 2 and the photosensitive drum 1 is ensured, and the occurrence of an uneven density of an image due to a permanent deformation of the elastic layer of the charging roller 2 can be suppressed.

Incidentally, in the case of moving from the first position to the second position, owing to the bent shape of a notch portion 490*g* when the protrusion 490*c* gets over a hooking portion 159*b* of the hook portion 159, the engagement between the separation member 490 and the hook portion 159 can be released.

Incidentally, even if the shaft holing portion according to this embodiment is shaped to be an elongated hole, this embodiment is applicable.

Moreover, this embodiment is also applicable to the second embodiment. In addition, the regulating portion receiving portion 151*b* may be provided at the photosensitive member unit 50.

Furthermore, although in each of the above-mentioned embodiments, a charging roller is described as a charging member, any charging member to be contacted with an electrophotograpic photosensitive member such as a charging blade may be employed.

According to the above-described embodiments, before use, a charging member can be separated from an electrophotographic photosensitive member, and in use, the separation state of the charging member can be released without an increase in the burden on a user.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-332739, filed Dec. 11, 2006, which is hereby incorporated by reference in its entirety.

What is claimed is:

1. A process cartridge detachably mountable to an electrophotographic image forming apparatus, the process cartridge comprising:

a photosensitive member unit including an electrophotographic photosensitive member and a fixed portion;

a developing unit movable relatively with respect to the photosensitive member unit, and including a developing roller developing an electrostatic latent image formed on the electrophotographic photosensitive member;

a charging member charging the electrophotographic photosensitive member; and a separation member movable between a first position to separate the charging member from the electrophotographic photosensitive member and a second position to abut the charging member on the electrophotographic photosensitive member, wherein the separation member includes an engaging portion releasably engaging with the fixed portion to position the separation member in the first position and a force receiving portion receiving a force from the developing unit for releasing an engagement between the fixed portion and the engaging portion to move the separation member to the second position when the developing unit is moved relatively with respect to the photosensitive member unit.

2. A process cartridge according to claim 1, further comprising a regulating portion receiving portion, wherein the separation member includes a regulating portion, and wherein the regulating portion is configured to abut on the regulating portion receiving portion to regulate a movement of the separation member in an opposite direction to an urging direction of urging the charging member to the electrophotographic photosensitive member when the separation member is positioned in the first position.

3. A process cartridge according to claim 1, wherein the separation member includes a shaft holding portion for holding a shaft of the charging member to separate the charging member from the electrophotographic photosensitive member, and wherein the shaft holding portion has a hole, and the shaft is held by an inner wall of the hole when the separation member is in the second position, and wherein when the separation member is positioned in the first position, there is a gap between the inner wall of the hole and the shaft in an opposite direction to an urging direction of urging the charging member to the electrophotographic photosensitive member as viewed from the shaft.

4. A process cartridge according to claim 1, wherein the fixed portion is a part of a photosensitive member frame that rotatably supports the electrophotographic photosensitive member and the charging member, and the force receiving portion receives a force from a part of a developing frame that rotatably supports the developing roller.

5. A process cartridge according to claim 1, further comprising an urging member urging the charging member toward the electrophotographic photosensitive member, and the separation member is positioned in the first position against an urging force of the urging member.

6. A process cartridge according to claim 1, wherein the developing unit is provided with a return portion for urging the separation member in order to return the separation member from the second position to the first position.

7. A process cartridge according to claim 1, wherein the developing unit is moved relatively with respect to the photosensitive member unit so that the developing unit moves between a contact position to contact the developing roller with the electrophotographic photosensitive member and a separation position to separate the developing roller from the electrophotographic photosensitive member.

8. A process cartridge according to claim 7, wherein the developing unit is moved between the contact position and the separation position by receiving a force from the electrophotographic image forming apparatus.

* * * * *